US010755646B2

(12) United States Patent
Yang et al.

(10) Patent No.: US 10,755,646 B2
(45) Date of Patent: Aug. 25, 2020

(54) DRIVING METHOD OF AN ORGANIC LIGHT-EMITTING DISPLAY DEVICE BASED ON DETECTING THRESHOLD VOLTAGES OF DRIVING TRANSISTORS AND/OR TURN-ON VOLTAGES OF ORGANIC LIGHT-EMITTING DIODES

(71) Applicant: BOE Technology Group Co., Ltd., Beijing (CN)

(72) Inventors: Fei Yang, Beijing (CN); Song Meng, Beijing (CN); Yue Wu, Beijing (CN); Yu Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 255 days.

(21) Appl. No.: 15/549,553

(22) PCT Filed: Feb. 17, 2017

(86) PCT No.: PCT/CN2017/073936
§ 371 (c)(1),
(2) Date: Aug. 8, 2017

(87) PCT Pub. No.: WO2018/023964
PCT Pub. Date: Feb. 8, 2018

(65) Prior Publication Data

US 2018/0240410 A1 Aug. 23, 2018

(30) Foreign Application Priority Data

Aug. 3, 2016 (CN) ..... 2016 1 0628525

(51) Int. Cl.
*G09G 3/30* (2006.01)
*G09G 3/3291* (2016.01)
(Continued)

(52) U.S. Cl.
CPC ..... *G09G 3/3291* (2013.01); *G09G 3/3266* (2013.01); *G09G 3/3283* (2013.01);
(Continued)

(58) Field of Classification Search
CPC .. G09G 3/3291; G09G 3/3266; G09G 3/3283; G09G 2300/0809
(Continued)

(56) References Cited

U.S. PATENT DOCUMENTS

2007/0236430 A1 10/2007 Fish
2009/0201281 A1 8/2009 Routley et al.
(Continued)

FOREIGN PATENT DOCUMENTS

CN 1965340 A 5/2007
CN 101263543 A 9/2008
(Continued)

OTHER PUBLICATIONS

May 12, 2017—(WO) International Search Report and Written Opinion Appn PCT/CN2017/073936 with English Tran.
(Continued)

*Primary Examiner* — Jonathan M Blancha
(74) *Attorney, Agent, or Firm* — Banner & Witcoff, Ltd.

(57) ABSTRACT

A driving method of an organic light-emitting display device, the display device includes a plurality of sub-pixels, each of the sub-pixels includes a driving transistor, an organic light-emitting diode and a sense line connected to the driving transistor and the organic light-emitting diode, the method includes: detecting threshold voltages of driving transistors of the sub-pixels or turn-on voltages of organic light-emitting diodes of the sub-pixels by sense lines; calculating a first driving voltage of a data driving circuit or a second driving voltage applied to anodes of the organic light-emitting diodes according to all detected threshold
(Continued)

voltages or detected turn-on voltages respectively; and based on the first driving voltage or the second driving voltage, applying data driving voltages and supply voltages to the sub-pixels.

20 Claims, 5 Drawing Sheets

(51) Int. Cl.
*G09G 3/3266* (2016.01)
*G09G 3/3283* (2016.01)

(52) U.S. Cl.
CPC ..... *G09G 2300/0809* (2013.01); *G09G 2300/0819* (2013.01); *G09G 2300/0842* (2013.01); *G09G 2320/0285* (2013.01); *G09G 2320/0295* (2013.01); *G09G 2320/045* (2013.01)

(58) Field of Classification Search
USPC ..... 345/76
See application file for complete search history.

(56) References Cited

U.S. PATENT DOCUMENTS

| | | | | |
|---|---|---|---|---|
| 2011/0102410 | A1* | 5/2011 | Cho | G09G 3/3291 345/212 |
| 2011/0279356 | A1 | 11/2011 | Takemura | |
| 2014/0152633 | A1* | 6/2014 | Park | G09G 3/3291 345/207 |
| 2014/0285407 | A1* | 9/2014 | Chaji | G09G 3/3233 345/76 |
| 2014/0313109 | A1* | 10/2014 | Ono | G09G 3/3258 345/76 |
| 2015/0001504 | A1 | 1/2015 | Kim et al. | |
| 2015/0053935 | A1 | 2/2015 | Gupta et al. | |
| 2016/0086546 | A1 | 3/2016 | Noh et al. | |
| 2016/0189629 | A1 | 6/2016 | Jin | |
| 2016/0247450 | A1* | 8/2016 | Liu | G09G 3/3258 |
| 2016/0314741 | A1* | 10/2016 | Yin | G09G 3/3258 |

FOREIGN PATENT DOCUMENTS

| | | | |
|---|---|---|---|
| CN | 104252836 | A | 12/2014 |
| CN | 104835469 | A | 8/2015 |
| CN | 105408813 | A | 3/2016 |
| CN | 105513541 | A | 4/2016 |
| CN | 106023892 | A | 10/2016 |
| JP | 2006215275 | A | 8/2006 |
| KR | 20160042269 | A | 4/2016 |
| KR | 20160088972 | A | 7/2016 |
| TW | 201415442 | A | 4/2014 |

OTHER PUBLICATIONS

Jan. 2, 2018—(CN) First Office Action Appn 201610628525.9 with English Tran.
Jan. 24, 2020—(EP) Supplementary Partial European Search Report Appn 17745960.9.

* cited by examiner

DRIVING METHOD OF AN ORGANIC LIGHT-EMITTING DISPLAY DEVICE BASED ON DETECTING THRESHOLD VOLTAGES OF DRIVING TRANSISTORS AND/OR TURN-ON VOLTAGES OF ORGANIC LIGHT-EMITTING DIODES

The application is a U.S. National Phase Entry of International Application No. PCT/CN2017/073936 filed on Feb. 17, 2017, designating the United States of America and claiming priority to Chinese Patent Application No. 201610628525.9, filed Aug. 3, 2016. The present application claims priority to and the benefit of the above-identified applications and the above-identified applications are incorporated by reference herein in their entirety.

TECHNICAL FIELD

Embodiments of the present disclosure relate to a driving method of an organic light-emitting display device.

BACKGROUND

At present, human beings not only have a high demand for appearance and quality of a product, but also pay more attention to the price and practicability of the product. In the display field, especially in the organic light-emitting diode (OLED) display field, due to factors such as the instability of a driving transistor and the aging of the OLED, for the same image data voltage, the currents flowing through the OLED are different at different times, so that the display panel has non-uniform brightness as a whole or presents ghost.

SUMMARY

At least one embodiment of the present disclosure provides a driving method of an organic light-emitting display device, the display device comprises a plurality of sub-pixels, each of the sub-pixels comprises a driving transistor, an organic light-emitting diode and a sense line connected to the driving transistor and the organic light-emitting diode, the method comprises: detecting threshold voltages of driving transistors of the sub-pixels or turn-on voltages of organic light-emitting diodes of the sub-pixels by sense lines; calculating a first driving voltage of a data driving circuit or a second driving voltage applied to anodes of the organic light-emitting diodes according to all detected threshold voltages or detected turn-on voltages respectively; and based on the first driving voltage or the second driving voltage, applying data driving voltages and supply voltages to the sub-pixels.

For instance, in some embodiments of the method, detecting the threshold voltages of the driving transistors of the sub-pixels by the sense lines comprises: writing an image data voltage to gate electrodes of the driving transistors; and reading stable voltages of the sense lines, calculating values of the threshold voltages of the driving transistors based on the stable voltages.

For instance, in some embodiments of the method, calculating the first driving voltage of the data driving circuit according to all the detected threshold voltages comprises: obtaining a maximum threshold voltage of all the driving transistors on the display panel based on the detected threshold voltages of all the driving transistors.

For instance, in some embodiments of the method, a latest first analog driving voltage value is calculated based on the maximum threshold voltage, the latest first analog driving voltage value is compared with a stored first analog driving voltage value, and in a case that the latest first analog driving voltage value is different from the stored first analog driving voltage value, the latest first analog driving voltage value is taken as the first driving voltage.

For instance, in some embodiments of the method, calculating the latest first analog driving voltage value based on the maximum threshold voltage comprises: obtaining a corresponding image data voltage when all the organic light-emitting diodes on the display panel produce a maximum brightness; obtaining a first difference; and calculating a sum of the corresponding image data voltage, the first difference and the maximum threshold voltage, and taking a calculated result as the first driving voltage.

For instance, in some embodiments of the method, the driving method of the organic light-emitting display device further comprises: in the case that the latest first analog driving voltage value is the same as the stored first analog driving voltage value, continuing to detect the threshold voltages of the driving transistors on the display panel.

For instance, in some embodiments of the method, the first driving voltage is transmitted to a voltage generating circuit of the data driving circuit by a TTL signal, an I2C signal or a differential signal.

For instance, in some embodiments of the method, the driving method of the organic light-emitting display device further comprises: detecting whether a command of closing a detecting process is received or not, and if the command is received, closing the detecting process; otherwise, continuing to detect the threshold voltages of the driving transistors on the display panel.

For instance, in some embodiments of the method, detecting the turn-on voltages of the organic light-emitting diodes of the sub-pixels by the sense lines comprises: applying a preset voltage to the organic light-emitting diodes to make the organic light-emitting diodes turn on; and reading stable voltages on the sense lines, calculating the turn-on voltages of the organic light-emitting diodes based on the stable voltages.

For instance, in some embodiments of the method, calculating the second driving voltage of the anodes of the organic light-emitting diodes according to all the detected turn-on voltages comprises: obtaining a maximum turn-on voltage of the plurality of organic light-emitting diodes on the display panel; calculating a latest voltage value applied to the anodes of the organic light-emitting diodes based on the maximum turn-on voltage that is obtained.

For instance, in some embodiments of the method, the method further comprises: determining a difference between the latest voltage value applied to the anodes of the organic light-emitting diodes and a previous voltage value applied to the anodes of the organic light-emitting diodes before, if the latest voltage value is the same as the previous voltage value, continuing to detect the turn-on voltages of the organic light-emitting diodes, and if the latest voltage value is different from the previous voltage value, taking the latest voltage value applied to the anodes of the organic light-emitting diodes as the second driving voltage.

For instance, in some embodiments of the method, calculating the latest voltage value applied to the anodes of the organic light-emitting diodes based on the obtained maximum turn-on voltage comprises: obtaining a corresponding light-emitting supply voltage when the organic light-emitting diodes on the display panel produce a maximum brightness; obtaining a second difference; and calculating a sum of the corresponding light-emitting supply voltage, the second difference and the maximum turn-on voltage, taking a calculated result as a latest ELVDD value.

For instance, in some embodiments of the method, the driving method of the organic light-emitting display device further comprises: in the case that the latest voltage value applied to the anodes of the organic light-emitting diodes is the same as the previous voltage value applied to the anodes of the organic light-emitting diodes before, continuing to detect the turn-on voltages of the organic light-emitting diodes.

For instance, in some embodiments of the method, the second driving voltage is transmitted to a voltage generating circuit by a TTL signal, an I2C signal or a differential signal.

For instance, in some embodiments of the method, the driving method of the organic light-emitting display device further comprises: detecting whether a command of closing a detecting process is received or not, if the command is received, closing the detecting process; otherwise, continuing to detect the turn-on voltages of all the organic light-emitting diodes on the display panel.

For instance, in some embodiments of the method, the driving method of the organic light-emitting display device comprises: detecting the threshold voltages of the driving transistors of the sub-pixels on the display panel and the turn-on voltages of the organic light-emitting diodes of the sub-pixels on the display panel by the sense lines; calculating the first driving voltage of the data driving circuit and the second driving voltage applied to anodes of the organic light-emitting diodes according to all the detected threshold voltages and the detected turn-on voltages respectively; and based on the first driving voltage and the second driving voltage, applying the data driving voltages and the supply voltages to the sub-pixels.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "include," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

Figure 1A:
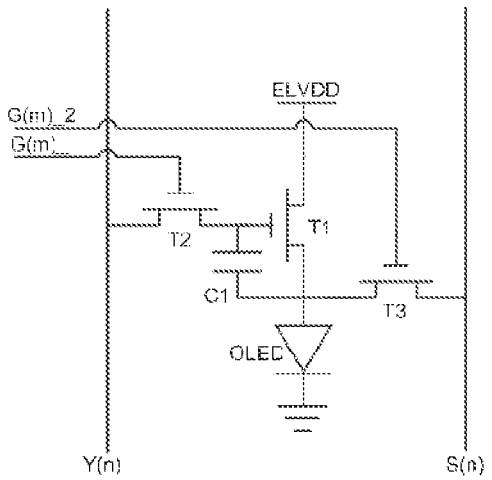
FIG. 1A is a schematic diagram of a sub-pixel driving circuit provided by an embodiment of the present disclosure.

The method provided by each of following embodiments, which can reduce power consumption, may be applied to a driving structure of an external compensation organic light-emitting sub-pixel circuit, and the driving structure may refer to FIG. 1A. FIG. 1A takes a sub-pixel in row m and column n as an example to describe, each of the sub-pixels comprises a driving transistor T1, a scan switch transistor T2, a sense switch transistor T3, a capacitor C1, a data line Y(n), a sense line S(n), a first scan line G(m)_1, a second scan line G(m)_2, a power line ELVDD and an OLED device. However, those skilled in the art should be understood that the present disclosure is not limited to the specific sub-pixel circuit illustrated in FIG. 1A, and the sub-pixel circuit of an embodiment of present disclosure may also have other structures, provided that the sub-pixel circuit can sense the related characteristics of the driving transistor and/or the OLED device.

Referring to FIG. 1A, the exemplary OLED pixel circuit 100 comprises an OLED pixel driving circuit and an organic light emitting diode (OLED). The organic light emitting diode emits light according to an electrical current flowing through the driving transistor T1. The anode of the organic light emitting diode may be connected to a source electrode of the driving transistor T1, and the cathode of the OLED may be grounded.

The organic light emitting diode may comprise the anode, a hole transport layer, an organic light-emitting layer, an electron transport layer, and the cathode. If a voltage is applied across the anode and the cathode of the organic light emitting diode, holes and electrons are injected and moved to the organic light-emitting layer through the hole transport layer and the electron transport layer respectively, and are recombined with each other in the organic light-emitting layer so as to excite to emit light.

The driving transistor T1 is disposed between a first power line ELVDD and the organic light emitting diode. The driving transistor T1 controls the electrical current, which flows from the first power line ELVDD to the OLED, according to a voltage difference applied between the gate electrode and the source electrode of the driving transistor T1. The gate electrode of the driving transistor T1 may be connected to a first electrode of the scan switch transistor T2, the source electrode of the driving transistor T1 may be connected to the anode of the organic light emitting diode, and the drain electrode of the driving transistor T1 may be connected to the first power line ELVDD which is applied with a first supply voltage.

The gate electrode of the scan switch transistor T2 is connected to the $M^{th}$ first scan line G(m)_1, and thus the scan switch transistor T2 can be switched on or off by a scan pulse over the first scan line G(m)_1, so as to transfer an image data voltage over the $N^{th}$ data line Y(n) to the gate electrode of the driving transistor T1. The first electrode (such as a drain electrode) of the scan switch transistor T2 may be connected to the gate electrode of the driving transistor T1, and a second electrode (such as a source electrode) of the scan switch transistor T2 may be connected to the $N^{th}$ data line Y(n).

The gate electrode of the sense switch transistor T3 is connected to the $M^{th}$ second scan line G(m)_2, and thus the sense switch transistor T3 can be switched on or off by a sense pulse over the second scan line G(m)_2, so as to connect the $N^{th}$ sense line S(n) to the source electrode of the driving transistor T1. The first electrode (such as a source electrode) of the sense switch transistor T3 may be connected to the $N^{th}$ sense line S(n), and the second electrode (such as a drain electrode) of the sense switch transistor T3 may be connected to the source electrode of the driving transistor T1.

The capacitor C1 is provided between the gate electrode and the source electrode of the driving electrode T1. The capacitor C1 stores the voltage difference between the gate electrode and the source electrode of the driving transistor T1.

As illustrated in FIG. 1A, the driving transistor T1, the scan switch transistor T2, the sense switch transistor T3 can be formed by an N type MOSFET (metal oxide semiconductor field effect transistor), but this arrangement is not limitative herein. In another example, the driving transistor T1, the scan switch transistor T2, the sense switch transistor T3 can be formed by a P type MOSFET. In addition, it should be noted that, as for the above mentioned transistor T2 and T3, one of the first electrode and the second electrode may be a source electrode, and correspondingly the other one may be a drain electrode.

In an organic light-emitting display device, a cross voltage may be changed due to factors such as the instability of a driving transistor and/or the aging of the organic light-emitting diode (OLED), even for the same light-emitting supply voltage, the currents flowing through the same OLED may be different at different times, so that the display panel has non-uniform brightness or presents ghost.

Figure 1B:
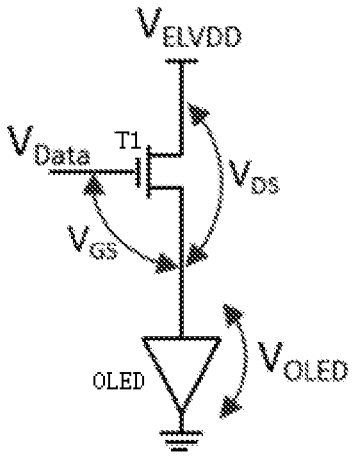
FIG. 1B is an enlarged schematic diagram of a driving transistor and an OLED of a sub-pixel driving circuit provided by an embodiment of the present disclosure.

FIG. 1B is an enlarged schematic diagram of a driving transistor and an OLED of an exemplary sub-pixel driving circuit provided by the present embodiment. Referring to FIG. 1B, a threshold voltage of the driving transistor T1 of the organic light-emitting sub-pixel driving circuit is Vth, a gate voltage of the driving transistor T1 is $V_{Data}$, a drain voltage of the driving transistor T1 is $V_{ELVDD}$, and the cross voltage (namely the turn-on voltage) of the OLED is $V_{OLED}$. In operation of the organic light-emitting display device, the driving transistor T1 is required to work in a saturation region (the saturation region includes a constant current region and an amplification region), and the condition, that a driving transistor works in the saturation region, is as follows:

$$V_{GS} \geq Vth, \text{ and } V_{DS} \geq V_{GS} - Vth$$

where $V_{GS}=V_{Data}$, $V_{DS}=V_{ELVDD}-V_{OLED}$.

From the above formula, it should be understood that if the value of the threshold voltage Vth of the driving transistor T1 is changed, the condition that the driving transistor T1 works in the saturation region can be satisfied by changing value of the image data voltage $V_{Data}$. If the turn-on voltage of the OLED device is changed, the condition that the driving transistor T1 works in the saturation region can be satisfied by changing value of the $V_{ELVDD}$ applied to the anode of the organic light-emitting diode.

In an organic light-emitting display device, in order to ensure that, for the same image data voltage, the currents flowing through the OLED device are the same at different times, if the threshold voltage Vth of the driving transistor T1 positively shifts, then the value of the input image date voltage $V_{Data}$ is increased. If the threshold voltage Vth of the driving transistor T1 negatively shifts, then the value of the input image date voltage $V_{Data}$ is reduced. In a source driver chip, the different image data voltage $V_{Data}$ values may be generated according to an analog driving voltage AVDD and image data, and the value of the analog driving voltage AVDD must be greater than the value of the image data voltage $V_{Datamax}$, the value of which makes the OLED device produce the required maximum brightness. If the threshold voltage Vth of the driving transistor T1 is changed, the value of the $V_{Datamax}$ is also changed, so that the value of the analog driving voltage AVDD needs to be changed correspondingly; finally the value of the analog driving voltage AVDD is optimal at all times, so as to achieve the purpose that the OLED display device reduces the power consumption under the initial circumstance.

In addition, in an OLED display device, the turn-on voltage $V_{OLED}$ of the OLED generally increases due to the aging of the OLED device. In order to ensure that the driving transistor works in the saturation region (namely $V_{DS} \geq V_{GS}-Vth$), the voltage $V_{ELVDD}$ applied to the anode of the organic light-emitting diode needs to be improved. Finally, the value of the $V_{ELVDD}$ is optimal at all times, so as to achieve the purpose that the OLED display device reduces the power consumption under the initial circumstance.

The driving method of the organic light-emitting display device provided by embodiments of the present disclosure is described in detail below in combination with FIG. 2-FIG. 7 and the above mentioned sub-pixel circuit.

Figure 2:
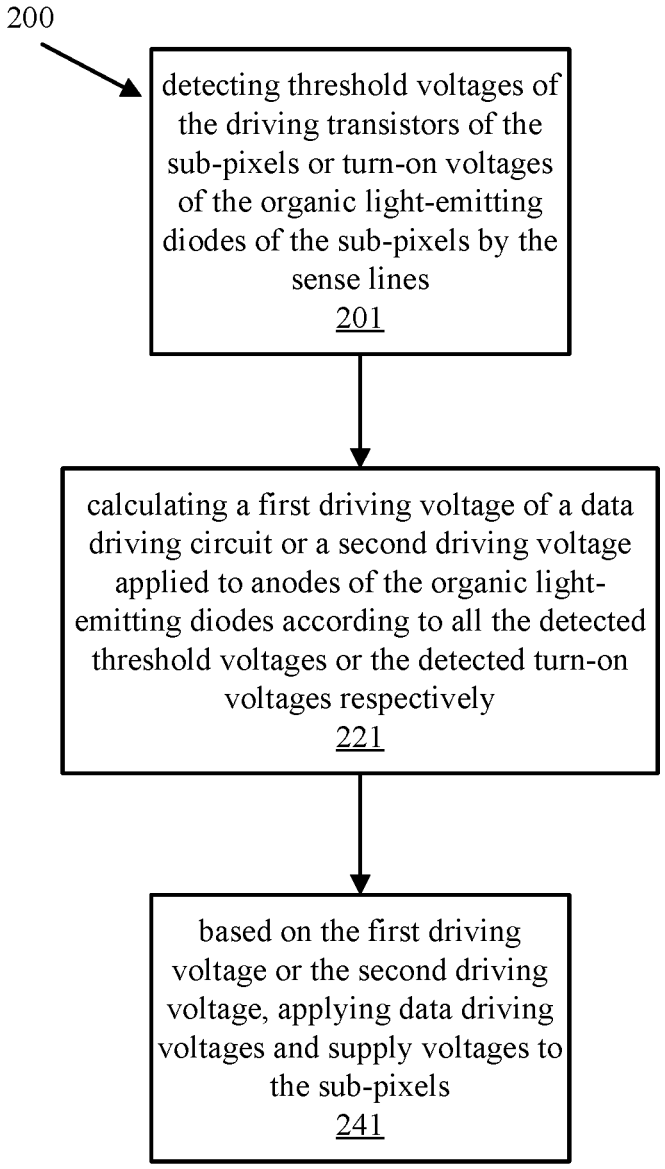
FIG. 2 is a flow chart of a driving method of an organic light-emitting display device provided by an embodiment of the present disclosure.

FIG. 2 is a flow chart of a driving method of an organic light-emitting display device provided by an embodiment of the present disclosure, for instance, here the organic light-emitting display device comprises a plurality of sub-pixels 100 as illustrated in FIG. 1A, each of the sub-pixels 100 comprises a driving transistor, an organic light-emitting diode, and a sense line connected to the driving transistor and the organic light-emitting diode (the specific structure can be referred to the description in FIG. 1A), the driving method 200 comprises the following steps:

Step 201, detecting threshold voltages of the driving transistors of the sub-pixels or turn-on voltages of the organic light-emitting diodes of the sub-pixels by the sense lines;

Step 221, calculating a first driving voltage of a data driving circuit or a second driving voltage applied to anodes of the organic light-emitting diodes according to all the detected threshold voltages or the detected turn-on voltages respectively; and Step 241, based on the first driving voltage or the second driving voltage, applying data driving voltages and supply voltages to the sub-pixels.

In some embodiments, for instance, detecting the threshold voltages of the driving transistors of the sub-pixels may comprise: writing image data voltages to gate electrodes of the driving transistors; and reading stable voltages of the sense lines, calculating the values of the threshold voltages of the driving transistors based on the stable voltages.

Figure 3:
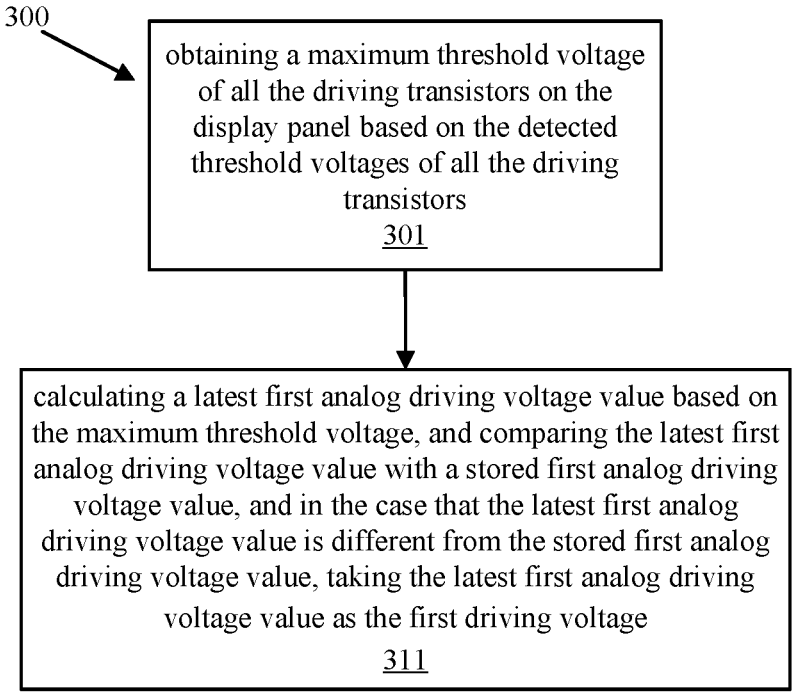
FIG. 3 is a flow chart of another driving method of an organic light-emitting display device provided by an embodiment of the present disclosure.

FIG. 3 a flow chart of another driving method of an organic light-emitting display device provided by an embodiment of the present disclosure. The driving method 300 of the organic light-emitting display device is a method for obtaining the first driving voltage, which is involved in the driving method 200 as illustrated in FIG. 2. The driving method 300 comprises the following steps:

Step 301, obtaining a maximum threshold voltage of all the driving transistors on the display panel based on the detected threshold voltages of all the driving transistors.

Step 311, calculating a latest first analog driving voltage value based on the maximum threshold voltage, and comparing the latest first analog driving voltage value with a stored first analog driving voltage value, in the case that the latest first analog driving voltage value is different from the stored first analog driving voltage value, taking the latest first analog driving voltage value as the first driving voltage.

In an example, calculating the latest first analog driving voltage value based on the maximum threshold voltage may comprise: obtaining a corresponding image data voltage when all the organic light-emitting diodes on the display panel produce the maximum brightness; obtaining a first difference; and calculating the sum of the corresponding image data voltage, the first difference and the maximum threshold voltage, taking a calculated result as the first driving voltage.

In an example, the driving method 300 of the organic light-emitting display device further comprises (not shown in figure): in the case that the latest first analog driving voltage value is the same as the stored first analog driving voltage value, continuing to detect the threshold voltages of the driving transistors on the display panel.

For instance, according to the circuit and signal design of the specific organic light-emitting display device, the first driving voltage is transmitted to a voltage generating circuit of the data driving circuit in a form such as TTL signal, I2C signal or differential signal, and etc.

In an example, the driving method of the organic light-emitting display device further comprises (not shown in figure): detecting whether a command of closing a detecting process is received or not, and if the command is received, closing the detecting process; otherwise, continuing to detect the threshold voltages of the driving transistors on the display panel.

In an example, steps of detecting the turn-on voltages of the organic light-emitting diodes of the sub-pixels by the sense lines may comprise: applying a preset voltage to the organic light-emitting diodes to make the organic light-emitting diodes turn on; and reading the stable voltages over the sense lines, and calculating the turn-on voltages of the organic light-emitting diodes based on the stable voltages.

Figure 4:
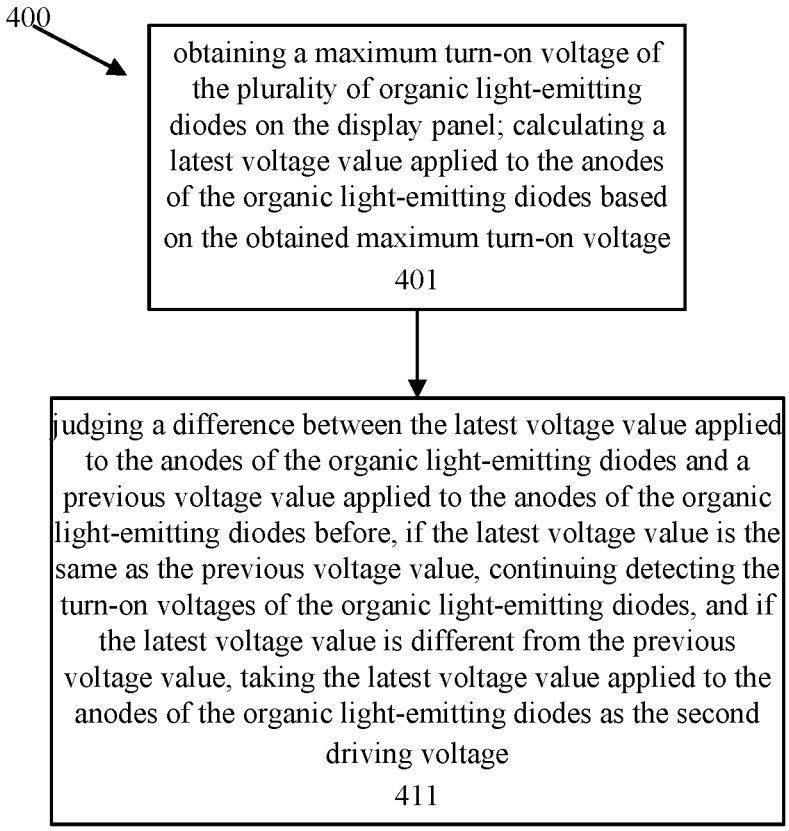
FIG. 4 is a flow chart of further another driving method of an organic light-emitting display device provided by an embodiment of the present disclosure.

FIG. 4 is a flow chart of another driving method of an organic light-emitting display device provided by an embodiment of the present disclosure. The driving method 400 of the organic light-emitting display device is a method for obtaining the second driving voltage, which is involved in the driving method 200 as illustrated in FIG. 2. The driving method 400 comprises the following steps:

Step 401, obtaining a maximum turn-on voltage of the plurality of organic light-emitting diodes on the display panel; calculating a latest voltage value applied to the anodes of the organic light-emitting diodes based on the obtained maximum turn-on voltage.

Step 411, determining a difference between the latest voltage value applied to the anodes of the organic light-emitting diodes and a previous voltage value applied to the anodes of the organic light-emitting diodes before, if the latest voltage value is the same as the previous voltage value, continuing to detect the turn-on voltages of the organic light-emitting diodes, and if the latest voltage value is different from the previous voltage value, taking the latest voltage value applied to the anodes of the organic light-emitting diodes as the second driving voltage.

In an example, step of calculating the latest voltage value applied to the anodes of the organic light-emitting diodes based on the obtained maximum turn-on voltage comprises: obtaining a corresponding light-emitting supply voltage when the plurality of organic light-emitting diodes on the display panel produce the maximum brightness; obtaining a second difference; and calculating the sum of the corresponding light-emitting supply voltage, the second difference and the maximum turn-on voltage, taking a calculated result as a latest ELVDD value.

For instance, the driving method 400 of the organic light-emitting display device further comprises (not shown in figure): in the case that the latest voltage value applied to the anodes of the organic light-emitting diodes is the same as the previous voltage value applied to the anodes of the organic light-emitting diodes before, continuing to detect the turn-on voltages of the plurality of organic light-emitting diodes.

For instance, the driving method 400 of the organic light-emitting display device further comprises transmitting the second driving voltage to the voltage generating circuit in a form such as TTL signal, I2C signal or differential signal and etc.

For instance, the driving method 400 of the organic light-emitting display device further comprises detecting whether a command of closing a detecting process is received or not, and if the command is received, closing the detecting process; otherwise, continuing to detect the turn-on voltages of all the organic light-emitting diodes on the display panel.

The detail process of the driving methods 200, 300 and 400 of the above mentioned organic light-emitting display device is further described below with two specific embodiments and in combination with the sub-pixel circuits illustrated in FIG. 1A and FIG. 1B

Embodiment 1

Figure 5A:
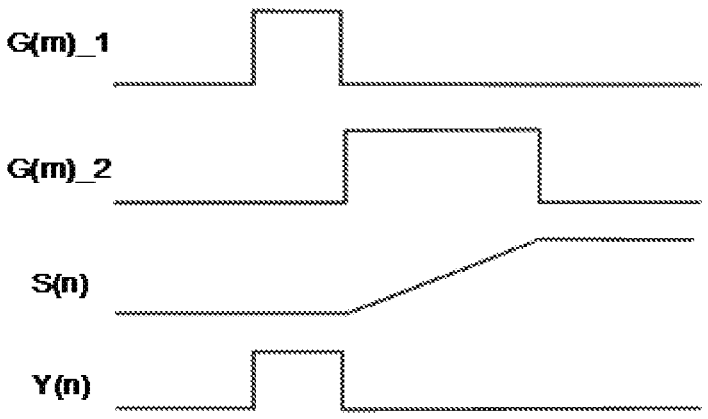
FIG. 5A is an oscillogram when detecting a threshold voltage of a driving transistor provided by an embodiment of the present disclosure.

The embodiment 1 is described in detail below in combination with FIG. 1A, FIG. 1B and FIG. 5A. FIG. 5A is an oscillogram when detecting a threshold voltage of a driving transistor provided by an embodiment of the present disclosure. In combination with FIG. 5A, it should be known that the figure provides sequence diagrams of the first scan line G(m)_1, the second scan line G(m)_2, the sense line S(n) and the data line Y(n) when detecting the threshold voltage of the driving transistor.

The threshold voltages Vth of the driving transistors in the plurality of the sub-pixels are detected. Firstly, the scan switch transistor T2 is switched on (at this time, the first scan line G(m)_1 is provided with a high level), a data voltage is written to the gate electrode of the driving transistor T1 from the $N^{th}$ data line Y(n); then, the first scan line G(m)_1 is closed, the sense switch transistor T3 is switched on (at this time, the second scan line G(m)_2 is provided with a high level); subsequently, the voltage on the sense line S(n) rises, and after a certain period of time, the voltage on the sense line S(n) reaches a stable potential. The threshold voltage Vth of the driving transistor T1 is calculated based on the stable potential, and the threshold voltage Vth is recorded as $Vth_{mn}$. In this way, the threshold voltages Vth of all the driving transistors (for instance, m×n driving transistors) of the OLED display device are detected, the maximum threshold voltage Vth value ($Vth_{max}$) over the whole OLED display device is selected, and may be represented as:

$$Vth_{max}=\mathrm{Max}(Vth_{01}, Vth_{02}, \ldots Vth_{mn})$$

The latest first analog driving voltage is calculated based on the maximum threshold voltage, namely the latest AVDD value is calculated. If $V_{Datamax}$ represents the value of the voltage $V_{Data}$ which makes the OLED device produce the maximum brightness, then the latest AVDD value $V_{AVDD'}$ is obtained as follows:

$$V_{AVDD}=V_{Datamax}+Vth_{max}+\Delta V1$$

where ΔV1 is the obtained first difference, and the value of ΔV1 is generally about 0.2 V.

The calculated $V_{AVDD'}$ value is compared with the previous stored $V_{AVDD}$ value, if the calculated $V_{AVDD'}$ value is the same as the previous stored $V_{AVDD}$ value, continuing to detect the threshold voltage Vth, if the calculated $V_{AVDD'}$ value is different from the previous stored $V_{AVDD}$ value, storing the latest calculated AVDD value (namely the $V_{AVDD'}$), taking the latest first analog driving voltage value as the first driving voltage, and sending the obtained latest first driving voltage value to the voltage generating circuit. If no $V_{AVDD}$ value has been stored before, namely at the initialization phase, then the current obtained $V_{AVDD}$ value is stored and is sent to the voltage generating circuit for carrying out subsequent operations.

The driving voltage is changed according to the obtained latest first driving voltage value. The voltage generating circuit receives the data related to the first driving voltage value, so as to change the previous voltage output value and output the obtained latest first driving voltage. The command data for transmitting the first driving voltage may be transmitted in a form such as TTL signal, I2C signal or differential signal.

Embodiment 2

Figure 5B:
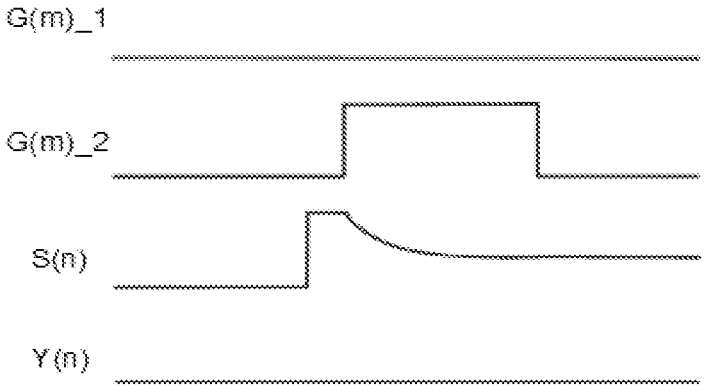
FIG. 5B is an oscillogram when detecting a turn-on voltage of an organic light-emitting diode provided by an embodiment of the present disclosure.

The embodiment 2 is described in detail below in combination with FIG. 1A, FIG. 1B and FIG. 5B. FIG. 5B is an oscillogram when detecting a turn-on voltage of an organic light-emitting diode provided by an embodiment of the present disclosure. In combination with FIG. 5B, it should be known that the figure provides sequence diagrams of the first scan line G(m)_1, the second scan line G(m)_2, the sense line S(n) and the data line Y(n) when detecting the turn-on voltage of the organic light-emitting diode.

The turn-on voltages of the organic light-emitting diodes in the plurality of the sub-pixels are detected. Firstly, the scan switch transistor T2 is switched off (at this time, the first scan line G(m)_1 is provided with a low level); then, the voltage on the sense line S(n) is preset to $V_{Sense}$, where $V_{Sense}>V_{OLED}$ and $V_{OLED}$ is the turn-on voltage of the organic light-emitting diode; next, the sense switch transistor T3 is switched on (at this time, the second scan line G(m)_2 is provided with a high level), the OLED device is turned on at this time, and then the voltage on the sense line S(n) drops. After a certain period of time, the voltage on the sense line S(n) reaches a stable potential, $V_{OLED}$ of the OLED device is calculated based on the stable potential and is recorded as $V_{OLEDmn}$. Similarly, the $V_{OLED}$ values of all the OLED devices (for instance, m×n OLED devices) of the organic light-emitting display device are detected, the maximum $V_{OLED}$ value in the whole organic light-emitting display device is selected, and may be represented as:

$$V_{OLEDmax}=\mathrm{Max}(V_{OLED01}, V_{OLED02}, \ldots V_{OLEDmn})$$

The ELVDD value is calculated, so as to obtain the latest ELVDD value $V_{ELVDD'}$, the $V_{ELVDD'}$ is as follows:

$$V_{ELVDD'}=V_{Datamax}+V_{OLEDmax}+\Delta V2$$

where ΔV2 is the obtained second difference, and the value of ΔV2 is generally about 0.2 V. $V_{Datamax}$ corresponds to the light-emitting supply voltage when the organic light-emitting diodes on the display panel produce the maximum brightness.

The calculated $V_{ELVDD'}$ value is compared with the previous stored $V_{ELVDD}$ value, if the calculated $V_{ELVDD'}$ value is the same as the previous stored $V_{ELVDD}$ value, continuing to detect the turn-on voltage of the organic light-emitting diode, if the calculated $V_{ELVDD'}$ value is different from the previous stored $V_{ELVDD}$ value, storing the latest calculated ELVDD value (namely the $V_{ELVDD}$), taking the latest calculated $V_{ELVDD'}$ as the second driving voltage, and sending the second driving voltage value to the voltage generating circuit. If no $V_{ELVDD}$ value has been stored before, namely at the initialization phase, then the current obtained $V_{ELVDD}$ value is stored and is sent to the voltage generating circuit for carrying out subsequent operations.

The ELVDD voltage is changed according to the second driving voltage value. The voltage generating circuit receives the command data related to the second driving voltage, so as to change the ELVDD voltage value. The present embodiment may transmit the command data used for changing the ELVDD voltage to the voltage generating circuit in the form such as TTL signal, I2C signal or differential signal.

Figure 6:
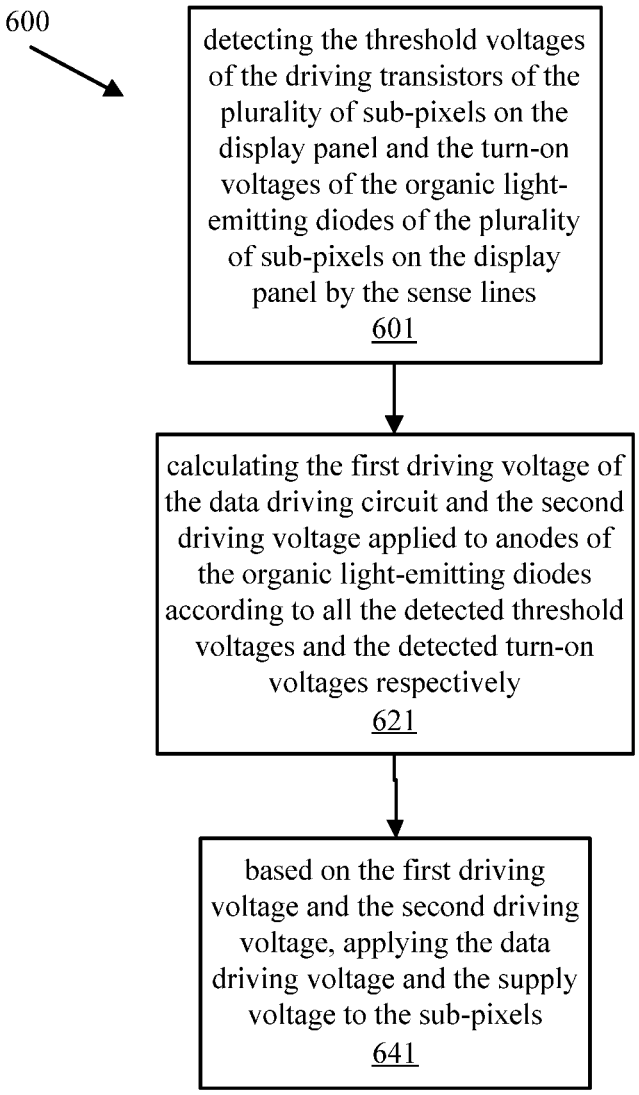
FIG. 6 is a flow chart of another driving method of an organic light-emitting display device provided by an embodiment of the present disclosure.

FIG. 6 is a flow chart of a driving method of an organic light-emitting display device provided by an embodiment of the present disclosure. The difference between the driving method 600 as illustrated in FIG. 6 and the driving method 200 as illustrated in FIG. 2 is that: the driving method 200 illustrated in FIG. 2 may only detect one of the threshold voltage and the turn-on voltage to obtain one of the first driving voltage and the second driving voltage, so as to realize the purpose of saving power consumption. However, the driving method 600 as illustrated in FIG. 6 is used for detecting both the threshold voltage and the turn-on voltage at the same time, and obtains both the first driving voltage and the second driving voltage, so that the purpose of saving power consumption is achieved. Therefore, compared with the driving method 200 provided by FIG. 2, the technical effect of the driving method 600 illustrated in FIG. 6 can be better.

The display device, to which the driving method 600 as illustrated in FIG. 6 relates, comprises a plurality of sub-pixels 100 as illustrated in FIG. 1A and FIG. 1B. Each of the sub-pixels 100 comprises a driving transistor, an organic light-emitting diode, and a sense line connected to the driving transistor and the organic light-emitting diode (for instance, referring to the descriptions of the FIG. 1A and FIG. 1B). The driving method 600 of the organic light-emitting display device in FIG. 6 may comprise the following steps:

Step 601: detecting the threshold voltages of the driving transistors of the plurality of sub-pixels on the display panel and the turn-on voltages of the organic light-emitting diodes of the plurality of sub-pixels on the display panel by the sense lines.

Step 621: calculating the first driving voltage of the data driving circuit and the second driving voltage applied to anodes of the organic light-emitting diodes according to all the detected threshold voltages and the detected turn-on voltages respectively.

Step 641: based on the first driving voltage and the second driving voltage, applying the data driving voltages and the supply voltages to the sub-pixels.

The implementation of the steps of the driving method 600 provided by FIG. 6 may be the same as the implementation of the similar steps of the driving method 200 as illustrated in FIG. 2, which will not be elaborated here.

In summary, the above mention embodiments of the present disclosure provide a method for reducing the power consumption of the organic display device, the method comprises detecting the threshold voltages Vth of the driving transistors and/or the turn-on voltages of the organic light-emitting diodes on the display panel, and then calculating the optimal AVDD voltage value and/or the optimal ELVDD voltage value which can satisfy the performance of the display panel, so that the power consumption of the AVDD and/or the ELVDD is optimized at any time, and then the purpose of reducing power consumption is achieved. In this way, the logic power consumption of the driving module and the power supply consumption of the organic light-emitting device can be reduced, and the power consumption of the organic light-emitting device can be maintained within an optimized range, so that the obtained display product is more competitive in the market.

The embodiments of the present disclosure only relate to the structure which the embodiments of the present disclosure relate to, the other structures may be referred to the customary design. Under the circumstance without conflict, the embodiments of the present disclosure or different features of each embodiment can be combined with each other.

What are described above is related to the specific embodiments of the present disclosure only and not limitative to the scope of the disclosure, within the disclosed technical scope of the disclosure, the change and replacement, which any skilled who is familiar with the technical field in the art may easily think of, should be covered within the scope of the protection of the disclosure. Therefore, the scopes of the disclosure are defined by the accompanying claims.

The application claims priority to the Chinese patent application No. 201610628525.9, filed Aug. 3, 2016, the entire disclosure of which is incorporated herein by reference as part of the present application.

What is claimed is:

1. A driving method of an organic light-emitting display device, the display device comprising a plurality of sub-pixels, each of the sub-pixels comprising a driving transistor, an organic light-emitting diode, a sense switch transistor, and a sense line, the sense line being directly connected to a first electrode of the sense switch transistor, and a second electrode of the sense switch transistor being directly connected to the driving transistor and the organic light-emitting diode, the method comprising:

detecting, via sense lines, threshold voltages of driving transistors of the sub-pixels or turn-on voltages of organic light-emitting diodes of the sub-pixels;

calculating a first driving voltage of a data driving circuit or a second driving voltage applied to anodes of the organic light-emitting diodes according to all detected threshold voltages or detected turn-on voltages respectively; and based on the first driving voltage or the second driving voltage, applying data driving voltages and supply voltages to the sub-pixels, wherein the calculating the first driving voltage of the data driving circuit according to all the detected threshold voltages comprises: obtaining a maximum threshold voltage of the driving transistors based on the detected threshold voltages of the driving transistors, and wherein a latest first analog driving voltage value is calculated based on the maximum threshold voltage, the latest first analog driving voltage value is compared with a stored first analog driving voltage value, and in a case that the latest first analog driving voltage value is different from the stored first analog driving voltage value, the latest first analog driving voltage value is taken as the first driving voltage.

2. The driving method of the organic light-emitting display device according to claim 1, wherein the detecting the threshold voltages of the driving transistors of the sub-pixels comprises:

writing an image data voltage to gate electrodes of the driving transistors; and reading stable voltages of the sense lines, calculating values of the threshold voltages of the driving transistors based on the stable voltages.

3. The driving method of the organic light-emitting display device according to claim 1, wherein calculating of the latest first analog driving voltage value based on the maximum threshold voltage comprises:

obtaining a corresponding image data voltage when all of the organic light-emitting diodes on the display device produce a maximum brightness;

obtaining a first difference; and calculating a sum of the corresponding image data voltage, the first difference, and the maximum threshold voltage, and taking a calculated result as the first driving voltage.

4. The driving method of the organic light-emitting display device according to claim 1, further comprising:

in the case that the latest first analog driving voltage value is the same as the stored first analog driving voltage value, continuing to detect the threshold voltages of the driving transistors.

5. The driving method of the organic light-emitting display device according to claim 1, further comprising: transmitting, by a TTL signal, an I2C signal, or a differential signal, the first driving voltage to a voltage generating circuit of the data driving circuit.

6. The driving method of the organic light-emitting display device according to claim 1, further comprising:

detecting whether a command of closing a detecting process is received or not, and if the command is received, closing the detecting process; otherwise, continuing to detect the threshold voltages of the driving transistors on the display device.

7. The driving method of the organic light-emitting display device according to claim 1, wherein the detecting the turn-on voltages of the organic light-emitting diodes of the sub-pixels comprises:

applying a preset voltage to the organic light-emitting diodes to make the organic light-emitting diodes turn on; and reading stable voltages on the sense lines, and calculating the turn-on voltages of the organic light-emitting diodes based on the stable voltages.

8. The driving method of the organic light-emitting display device according to claim 7, wherein the calculating the second driving voltage of the anodes of the organic light-emitting diodes according to all the detected turn-on voltages comprises:

obtaining a maximum turn-on voltage of the organic light-emitting diodes; and calculating a latest voltage value applied to the anodes of the organic light-emitting diodes based on the maximum turn-on voltage that is obtained.

9. The driving method of the organic light-emitting display device according to claim 8, further comprising:

determining a difference between the latest voltage value applied to the anodes of the organic light-emitting diodes and a previous voltage value applied to the anodes of the organic light-emitting diodes, if the latest voltage value is the same as the previous voltage value, continuing to detect the turn-on voltages of the organic light-emitting diodes, and if the latest voltage value is different from the previous voltage value, taking the latest voltage value applied to the anodes of the organic light-emitting diodes as the second driving voltage.

10. The driving method of the organic light-emitting display device according to claim 8, wherein the calculating the latest voltage value applied to the anodes of the organic light-emitting diodes based on the obtained maximum turn-on voltage comprises:

obtaining a corresponding light-emitting supply voltage when the organic light-emitting diodes produce a maximum brightness;

obtaining a second difference; and calculating a sum of the corresponding light-emitting supply voltage, the second difference, and the maximum turn-on voltage, taking a calculated result as a latest ELVDD value.

11. The driving method of the organic light-emitting display device according to claim 8, further comprising:

in the case that the latest voltage value applied to the anodes of the organic light-emitting diodes is the same as a previous voltage value applied to the anodes of the organic light-emitting diodes before, continuing to detect the turn-on voltages of the organic light-emitting diodes.

12. The driving method of the organic light-emitting display device according to claim 1, further comprising:

detecting whether a command of closing a detecting process is received or not, and if the command is received, closing the detecting process; otherwise, continuing to detect the turn-on voltages of all the organic light-emitting diodes on the display device.

13. The driving method of the organic light-emitting display device according to claim 7, further comprising: transmitting, by a TTL signal, a I2C signal, or a differential signal, the second driving voltage to a voltage generating circuit.

14. A driving method of an organic light-emitting display device, the display device comprising a plurality of sub-pixels, each of the sub-pixels comprising a driving transistor, an organic light-emitting diode, and a sense line connected to the driving transistor and the organic light-emitting diode, the method comprising:

detecting, via sense lines, turn-on voltages of organic light-emitting diodes of the sub-pixels;

calculating a second driving voltage applied to anodes of the organic light-emitting diodes according to all detected turn-on voltages; and based on the second driving voltage, applying data driving voltages and supply voltages to the sub-pixels, wherein the calculating the second driving voltage applied to the anodes of the organic light-emitting diodes according to all the detected turn-on voltages comprises:

obtaining a maximum turn-on voltage of the organic light-emitting diodes; and calculating a latest voltage value applied to the anodes of the organic light-emitting diodes based on the maximum turn-on voltage that is obtained.

15. The driving method of the organic light-emitting display device according to claim 14, further comprising:

determining a difference between the latest voltage value applied to the anodes of the organic light-emitting diodes and a previous voltage value applied to the anodes of the organic light-emitting diodes, if the latest voltage value is the same as the previous voltage value, continuing to detect the turn-on voltages of the organic light-emitting diodes, and if the latest voltage value is different from the previous voltage value, taking the latest voltage value applied to the anodes of the organic light-emitting diodes as the second driving voltage.

16. The driving method of the organic light-emitting display device according to claim 14, wherein the calculating the latest voltage value applied to the anodes of the organic light-emitting diodes based on the obtained maximum turn-on voltage comprises:

obtaining a corresponding light-emitting supply voltage when the organic light-emitting diodes produce a maximum brightness;

obtaining a second difference; and calculating a sum of the corresponding light-emitting supply voltage, the second difference, and the maximum turn-on voltage, taking a calculated result as a latest ELVDD value.

17. The driving method of the organic light-emitting display device according to claim 14, further comprising:

in the case that the latest voltage value applied to the anodes of the organic light-emitting diodes is the same as a previous voltage value applied to the anodes of the organic light-emitting diodes before, continuing to detect the turn-on voltages of the organic light-emitting diodes.

18. The driving method of the organic light-emitting display device according to claim 14, further comprising: transmitting, by a TTL signal, a I2C signal, or a differential signal, the second driving voltage to a voltage generating circuit.

19. The driving method of the organic light-emitting display device according to claim 14, further comprising:

detecting whether a command of closing a detecting process is received or not, and if the command is received, closing the detecting process; otherwise, continuing to detect the turn-on voltages of all the organic light-emitting diodes on the display device.

20. A driving method of an organic light-emitting display device, the display device comprising a plurality of sub-pixels, each of the sub-pixels comprising a driving transistor, an organic light-emitting diode, and a sense line connected to the driving transistor and the organic light-emitting diode, the method comprising:

detecting, via sense lines, threshold voltages of driving transistors of the sub-pixels and turn-on voltages of organic light-emitting diodes of the sub-pixels;

calculating a first driving voltage of a data driving circuit and a second driving voltage applied to anodes of the organic light-emitting diodes according to all detected threshold voltages and detected turn-on voltages respectively; and based on the first driving voltage and the second driving voltage, applying data driving voltages and supply voltages to the sub-pixels.

* * * * *